United States Patent [19]

Redfern

[11] 4,001,530

[45] Jan. 4, 1977

[54] ICE BREAKING DEVICE FOR DISCONNECT SWITCH CONTACT ASSEMBLIES

[75] Inventor: Calvin E. Redfern, Portland, Oreg.

[73] Assignee: Allis-Chalmers Corporation, Milwaukee, Wis.

[22] Filed: Dec. 11, 1975

[21] Appl. No.: 639,809

[52] U.S. Cl. ..... 200/48 A; 200/238

[51] Int. Cl.[2] ..... H01H 31/00

[58] Field of Search ..... 200/48 A, 48 SB, 48 R, 200/238, 48 CB, 48 P

[56] References Cited

UNITED STATES PATENTS 3,836,737 9/1974 Redfern ..... 200/48 A

*Primary Examiner*—Herman J. Hohauser

*Attorney, Agent, or Firm*—Robert C. Jones

[57] ABSTRACT

The disconnect switch blade, prior to the engagement of the blade plug with the switch contact shoes, engages with a curved upper portion of an ice breaker lever to effect its pivotal movement and thereby move a plurality of associated ice breaker bars from between the switch contact shoes to remove accumulated ice from the contact shoes.

9 Claims, 3 Drawing Figures

ICE BREAKING DEVICE FOR DISCONNECT SWITCH CONTACT ASSEMBLIES

BACKGROUND OF THE INVENTION

Ice has always been a problem in the operation of outdoor switches and especially so with switches that remain in one position for a relatively long period of time. In the past, crushing has been relied on to remove ice from contacts or contact shoes. This, of course, requires more energy to develop arm acceleration for effecting the forceful engagement of the blade contact with the contact shoes to crush and shatter the ice.

In U.S. Pat. 3,836,737, a disconnect switch is disclosed having a cam guide on the stationary contact portion of the disconnect switch which cooperates with a cam member on the rotary blade. The cam member cooperating with the follower forces the rotary blade to pivot to forcefully engage the blade contact with the contact shoes. The force exerted by the arrangement is sufficiently strong enough to break ice accumulation.

In U.S. Pat. No. 3,388,225, a disconnect switch is disclosed having a beavertail blade contact of perpendicularly aligned major and minor diameters of specific relationship. The beavertail structure is designed to cooperate with a jaw structure comprised of confronting contact surfaces. The beavertail structure enters between the confronting contact surfaces with the higher of the two beavertail contact surfaces aligned to engage with the jaw contact surface which is substantially straight over its entire length. The substantially straight contact surface is extended to cooperate with the beavertail contact surface to provide a large shearing force which is stated as shearing away ice.

These patents exemplify the various approaches of crushing ice to rid the contact shoes of the highly undesirable element.

SUMMARY OF THE INVENTION

This invention relates to a method and apparatus for peeling ice from the contact shoes of outdoor switches, and particularly, from the contact shoes of a vertical break disconnect switch. The instant invention discloses a novel contact shoe arrangement which includes means actuated by the blade arm for peeling ice from the contact shoes. The contact shoes are spaced apart to provide room for bar members which are actuated outwardly from between adjacent contact shoes by the blade arm prior to the blade contact making contact with the contact shoes. The outward movement of the bars from a recessed position between adjacent contact shoes pushes the ice encrusting the contact shoes from the shoes. Thus, no additional force other than the normal blade movement is required.

DESCRIPTION OF THE INVENTION

Figure 3:
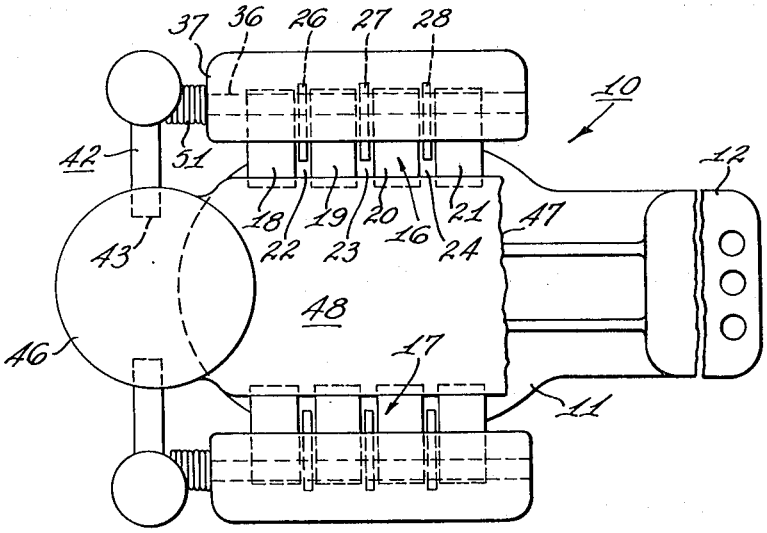
FIG. 3 is a top plane view of FIG. 1.
Figure 1:
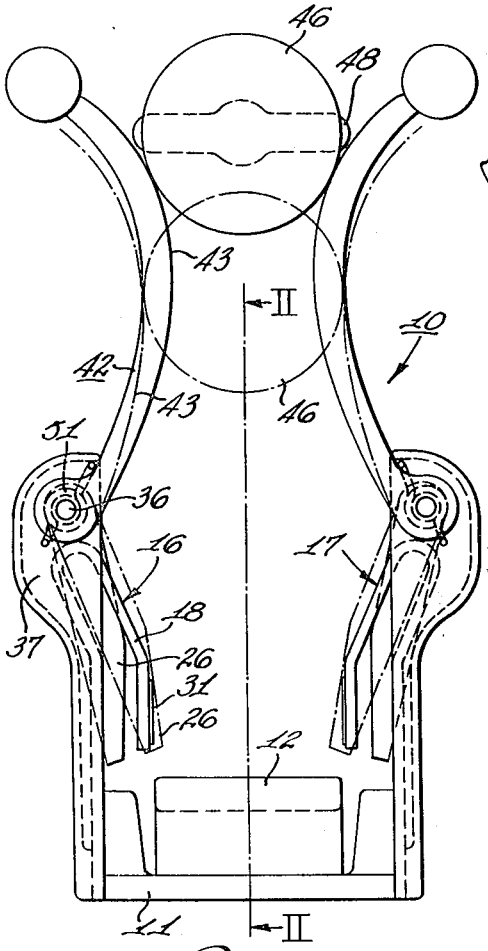
FIG. 1 is an end view in elevation of a disconnect contact shoe assembly incorporating the present invention.
Figure 2:
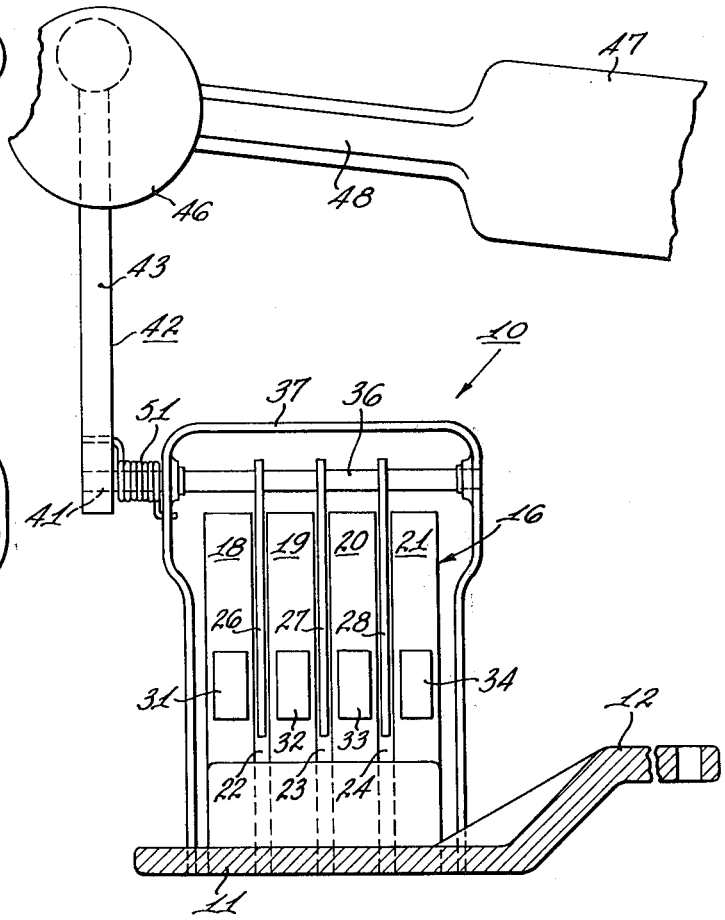
FIG. 2 is a view in vertical section taken in a plane represented by the line II—II in FIG. 1.

The disconnect switch contact shoe assembly 10 includes a base plate 11 including a rearwardly extending terminal pad 12. Upstanding from the base plate 11 on each side thereof is a set of contact shoes 16 and 17, respectively. The arrangement and construction of the contact shoe sets 16 and 17 are identical and the description given for the contact shoe set 16 will also apply to the set 17. The contact shoe set 16 includes a plurality of contact shoes 18, 19, 20 and 21 which, in the present instances, are shown as being of leaf spring construction. The contact shoes 18 through 21 are spaced apart to provide spaces 22, 23 and 24. Disposed within each of the spaces 22, 23 and 24 are bar members 26, 27 and 28 which are constructed and arranged when in a retracted noninterferring position to lay below the contact surfaces 31, 32, 33 and 34 of the contact shoes 18, 19, and 21, respectively. At their upper ends, the bar members 26, 27 and 28 are secured to a shaft 36, as by being welded thereto. The shaft 36 is supported for rotation about its own axis in the ends of a side shield 37 which is affixed to and is upstanding from the base plate 11. To the extending end 41 of the shaft 36 there is affixed a curved lever member 42 which may be keyed or welded to the shaft as desired. The convex surface 43 of the lever member 42 is disposed to face inwardly toward the other contact shoe set 17 and is in the path of travel of a corona ball 46 that is carried on the end of a pivoted blade arm 47 forward of beavertail blade contact 48 thereof. The particular type of disconnect switch herein contemplated is of the vertical break type, thus the blade 47 moves in its pivotal movement from a vertical open position to a horizontally closed position. As the blade 47 is pivoted downwardly, the corona ball 46 will first engage the convex surface 43 of the lever member 42 to effect pivotal movement of the lever member 42 in a counterclockwise direction, as viewed in FIG. 1. The counterclockwise movement of the lever member 42 causes the shaft 36 to rotate in a counterclockwise direction thereby moving the bar members 26, 27 and 38 in a counterclockwise direction. Thus, the bar members are moved out of the spaces 22, 23 and 24 and operate to push the ice which may have accumulated on the contact shoes 18, 19, 20 and 21 from the shoes to provide an ice-free surface for the beavertail contact 48 to engage with. As the blade 47 continues on its downward movement, the corona ball 46 disengages from the convex surface 43 of the lever 42 as the beavertail contact 48 moves into position between the contact shoe of the sets 16 and 17. As the beavertail contact 48 moves into closed position between the contact shoe sets, the bar members 26, 27 and 28 are retracted inwardly into the spaces 22, 23 and 24 to a retracted noninterfering position.

To this end, a torsion spring 51 is mounted around the shaft 36 between the shield 37 and the lever 42. The torsion spring 51 is anchored to the shield 37 and is connected to the lever 42 in a manner to constantly bias the lever 42 in a clockwise direction for the purpose of retaining the bar members 26, 27 and 28 in a retracted position. Thus, as the beavertail contact 48 of the arm blade 47 continues in its downward movement to a closed position, the corona ball 46 releases from its contact with the convex surface 43 of the lever 42 and the torsion spring 51 effects the retraction of the ice breaking bars 26, 27 and 28.

Thus, the ice breaker bars 26, 27 and 28 are always urged into a retracted position between the contact shoes 18, 19, 20 and 21 and are displaced outwardly therefrom only when the corona ball 46 of the blade arm 47 engages with the convex surface 43 of the lever 42. The engagement of the corona ball 46 with the convex surface 43 of the lever 42 in a blade arm closing movement moves the ice breaker bars 26, 27 and 28 outwardly to peel ice from the contact shoes. In an opening movement of the blade arm 47, the corona ball 46 will engage the lever 42 but as soon as contact therebetween is lost, the torsion spring 51 operates to effect the retraction of the ice breaker bars 26, 27 and 28 so that they are in position to peel ice from the contact shoes in the next switch closing operation.

The embodiments of the invention in which an exclusive property or privilege is claimed are defined as follows:

1. In a disconnect switch having a contact blade arm movable between an open and a closed position, the contact blade arm including a contact portion, a contact assembly having a pair of contact sets arranged in spaced apart relationship to receive the contact portion of said blade arm therebetween, mechanical ice removing means carried by at least one of said contact sets to remove ice from the associated contact set prior to said contact portion of said blade arm entering into contact engagement with said contact sets, and operating means actuated by the said contact blade arm to operate said ice mechanical removing means.

2. In a disconnect switch having a contact blade arm movable between an open and a closed position, the contact blade arm including a contact portion, a contact assembly having a pair of contact sets arranged in spaced apart relationship to receive the contact portion of said blade arm therebetween, said contact sets each including a plurality of contact shoes which are engaged by said contact portion of said blade arm for completing a circuit therethrough, ice removing means carried by at least one of said contact sets to mechanically remove ice from the associated contact set prior to said contact of said blade arm entering into contact engagement with said contact shoes, and, operating means actuated by said contact blade arm to operate said ice removing means.

3. A disconnect switch according to claim 2 wherein there is provided reset means operably connected to position said mechanical ice removing means upon an opening movement of the blade arm for a subsequent ice removing operation.

4. A disconnect switch according to claim 3 wherein said mechanical ice removing means includes a bar member disposed between adjacent contact shoes of said contact sets, and said operating means is operably connected to said bar member to actuate said bar members in unison in an ice removing operation.

5. A disconnect switch according to claim 4 wherein said bar members are carried on a rotatable shaft member operatively associated with said contact set, said operating means is operably connected to said shaft to rotate said shaft when actuated by the blade arm in a closing movement for effecting pivotal movement of said bar member from between adjacent contact shoes to remove ice from said contact shoes, and, said reset means is operably connected to effect a retraction of said bar members to a noninterfering position between adjacent contact shoes in readiness for a subsequent ice removing operation.

6. A disconnect switch according to claim 5 wherein said operating means is a lever operatively connected to effect rotation of said shaft, said lever being constructed and arranged to be engaged by said blade arm as it moves to a switch closed position prior to said contact portion engaging with the contact shoes of said contact set.

7. A disconnect switch according to claim 7 wherein said lever is constructed with an arcuate configuration and is secured to said shaft in a manner that the convex surface of said arcuate configured lever is disposed in the path of travel of said blade arm in its movement to a switch closed position.

8. A disconnect switch according to claim 7 wherein said blade arm is provided with a corona ball at its free end, said corona ball being adapted to engage the convex surface of said arcuate configured lever to thereby move said lever in a direction to operate said bar members in an ice removing operation.

9. A disconnect switch according to claim 8 wherein said reset means is a torsion spring engaged on said shaft in a manner to bias said shaft in a direction for retracting said bar member between said contact shoes to a noninterfering ready position.

* * * * *

UNITED STATES PATENT OFFICE

CERTIFICATE OF CORRECTION

Patent No. 4,001,530 Dated January 4, 1977

Inventor(s) Calvin E. Redfern

It is certified that error appears in the above-identified patent and that said Letters Patent are hereby corrected as shown below:

Column 3, line 25, "ice mechanical" should read --- mechanical ice --- .

Column 4, line 30, "claim 7" should read --- claim 6 --- .

Signed and Sealed this

Thirty-first Day of May 1977

[SEAL]

*Attest:*

RUTH C. MASON
*Attesting Officer*

C. MARSHALL DANN
*Commissioner of Patents and Trademarks*